US006308996B1

(12) United States Patent
Ganimian

(10) Patent No.: US 6,308,996 B1
(45) Date of Patent: Oct. 30, 2001

(54) ENTRY DOOR BARRICADE FOR RECREATIONAL VEHICLES AND THE LIKE

(76) Inventor: George Ganimian, Boston Gun & Rifle Association, 7 Faulkner St., Dorchester, MA (US) 02122

( * ) Notice: Subject to any disclaimer, the term of this patent is extended or adjusted under 35 U.S.C. 154(b) by 0 days.

(21) Appl. No.: 09/417,647

(22) Filed: Oct. 14, 1999

(51) Int. Cl.[7] ..... E05C 19/18; E05F 5/00; E05B 73/00

(52) U.S. Cl. ..... 292/259 R; 16/82; 70/14

(58) Field of Search ..... 292/259 R, 290, 292/292, 297, 339, 343, 283, 284; 16/82; 70/DIG. 64, DIG. 65, DIG. 66

(56) References Cited

U.S. PATENT DOCUMENTS

| | | |
|---|---|---|
| 771,753 | 10/1904 | Stanley . |
| 1,657,908 | 1/1928 | Wulftange . |
| 2,764,442 | 9/1956 | Weaver . |
| 2,877,840 | 3/1959 | Hurwitz et al. . |
| 3,805,322 | 4/1974 | Serrano . |
| 3,833,963 | 9/1974 | Waters . |
| 3,952,453 | 4/1976 | Amburgey . |
| 4,333,271 | 6/1982 | Depaolo et al. . |
| 4,384,436 | 5/1983 | Green . |
| 4,480,405 | 11/1984 | Ferguson . |
| 4,747,181 | 5/1988 | Davis . |
| 4,822,206 | 4/1989 | Roussel et al. . |
| 5,207,026 | 5/1993 | Bozeman, Jr. . |
| 5,454,610 | 10/1995 | Taylor et al. . |
| 5,623,791 | 4/1997 | Schwarz . |
| 5,787,548 | 8/1998 | Tzen . |

FOREIGN PATENT DOCUMENTS

| | | |
|---|---|---|
| 2749134 | 5/1979 | (DE) . |
| 2155980 | 10/1985 | (GB) . |
| 2178094 | 2/1987 | (GB) . |
| 2203471 | 10/1988 | (GB) . |

*Primary Examiner*—Anthony Knight
*Assistant Examiner*—Matthew E. Rodgers
(74) *Attorney, Agent, or Firm*—Lambert & Associates, PLLC; Gary E. Lambert; Edward Timmer

(57) ABSTRACT

A door barricade that removably mounts on the steps of a recreational vehicle and the like that prevents the opening of the door beyond a predetermined point. The door barricade of the present invention comprises a step engaging member and a door stop member. The step engaging member securely grips the top step leading to the entry door of a RV and the like and the door stop member extends upward from the step engaging member in close proximity to the door of the RV and the like in the installed and functional configuration, thereby preventing the outward swinging door of a RV and the like from opening. The door barricade is further foldable for storage and transporting purposes. Additionally, the door barricade is adjustable to accommodate RVs and the like having a variety of step-to-door relationships.

11 Claims, 2 Drawing Sheets

ENTRY DOOR BARRICADE FOR RECREATIONAL VEHICLES AND THE LIKE

BACKGROUND OF THE INVENTION

This invention relates to door security barricades. More particularly, this invention relates to a recreational vehicle (RV) entry door barricade that mounts on the steps leading to the entry door of a recreational vehicle and prevents the opening of the entry door.

Recreational vehicles(RVs), storage trailers, travel trailers, campers and the like typically have steps leading to the entry door of said vehicles. Furthermore, recreational vehicles are typically constructed, in large part, of lightweight materials such as lightweight alloys, composites and plastics in order to improve gas mileage and/or ease of towing. Due to the choice of materials for construction, the entry doors of RVs pose an inviting and not-too-formidable obstacle to burglars and vandals. The entry doors of RVs also pose a natural point of entry since the windows of RVs are typically too small to accommodate burglars and vandals seeking to gain uninvited entry into a RV.

In U.S. Pat. No. 4,474181 granted to Davis there is disclosed a door retainer that is attached to the steps of an RV or the like for preventing the door from opening. The device disclosed therein accommodates steps and a door-to-step configuration of a particular size—the device is not adjustable. The disclosed device also merely attaches to the steps of the RV. Therefore, the security benefits of the device may be circumvented by merely removing the steps from the RV, leaving the burglar or vandal unimpeded access to an otherwise intact RV and door. The Davis device is also inconvenient to store and transport when the device is not in use.

SUMMARY OF THE INVENTION

It is therefore an object of this invention to provide a door barricade that is quickly and easily installed on the steps leading to the door of a recreational vehicle for preventing the opening of the door beyond a predetermined point.

It is also an objective of the present invention to provide a door barricade that is selectively locked such that the door to a RV is securely prevented from opening.

It is also an objective of the present invention to provide a door barricade that is adjustable and can accommodate RVs having a variety of step-to-door relationships, thus the present invention may be used on existing and future RVs produced by a variety of RV manufacturers.

It is also an objective of the present invention to provide a door barricade that is compactly and easily stored when not installed in its functional configuration.

It is also an objective of the present invention to provide a door barricade that is inexpensive to manufacture and easy to install.

It is also an objective of the present invention to provide a door barricade that does not require tools to assemble or disassemble.

This invention results from the realization that a highly adaptable, secure yet simple and easily stored door barricade is effectuated by making the door barricade of a step engaging member that securely attaches to the top step of an RV and a door stop member that is attached to the step engaging member and upwardly extending from the step engaging member such that the door of a RV is prevented from opening when the door barricade of the present invention is installed on the step of a RV. The door barricade of the present invention is installed without the use of tools and is selectively and securely lacked to the RV.

This invention features a door barricade comprising a top step portion that is positioned atop a RV top step; a rear step portion that is attached to the top step portion and extends downward from the top step portion and is positioned at and engages the rear edge of the RV top step; a bottom step portion that is attached to the rear step portion and positioned to engage the bottom of the top step; and a front step portion that is attached to the top step portion and extends downward from the top step portion and is positioned to engage the front edge of the RV top step such that these combined components are configured to grip the top step of RV steps leading to the entry door of a RV. This invention further includes a door stop member that is attached to the step engaging member components that is attached to the step engaging member in adjustable relationship and extends upward from the step engaging member. The upwardly extending door stop member thereby blocks and otherwise prevents the door of the RV from opening when the door barricade of the present invention is installed on the top step of a RV steps leading to the entry door of a RV.

The door stop member and the door engaging members of the present invention are typically adjustable in relation to one another whereby the present invention may be installed successfully and properly functioning on RVs having a variety of top step-to-entry door spaced relationships without compromising the security benefits of the present invention. Additionally, the door stop member and the step engaging member of the present invention can typically be adjusted and locked at predetermined locations by locking means of the device user's preference, thereby ensuring that the door barricade cannot unintentionally become disengaged from the top step of the RV to which it is installed.

The door stop member of the present invention is typically further pivotally attached to the top step portion of the step engaging member. Pivotal attachment of the door stop member to the step engaging member enables the door barricade of the present invention to be easily stored and transported when not in use. This feature is greatly appreciated by those skilled in the art and familiar with the limited storage space common in RVs.

The door stop member also typically has cross bar members that add strength and rigidity, and thus added security benefits, to the door stop member. The door stop member may also have eye slots to receive the eyelets of eyebolts attached to the RV. The eyelet of an eye bolt attached to the RV is inserted through the eye disposed on the door stop cross bar and selectively locked by locking means of the device user's preference. The eye slot for receiving an eyelet of an eyebolt may alternatively be a disposed on a portion of the door stop member that extends upwardly from said step engaging member.

DETAILED DESCRIPTION OF THE PREFERRED EMBODIMENT

Figure 1:
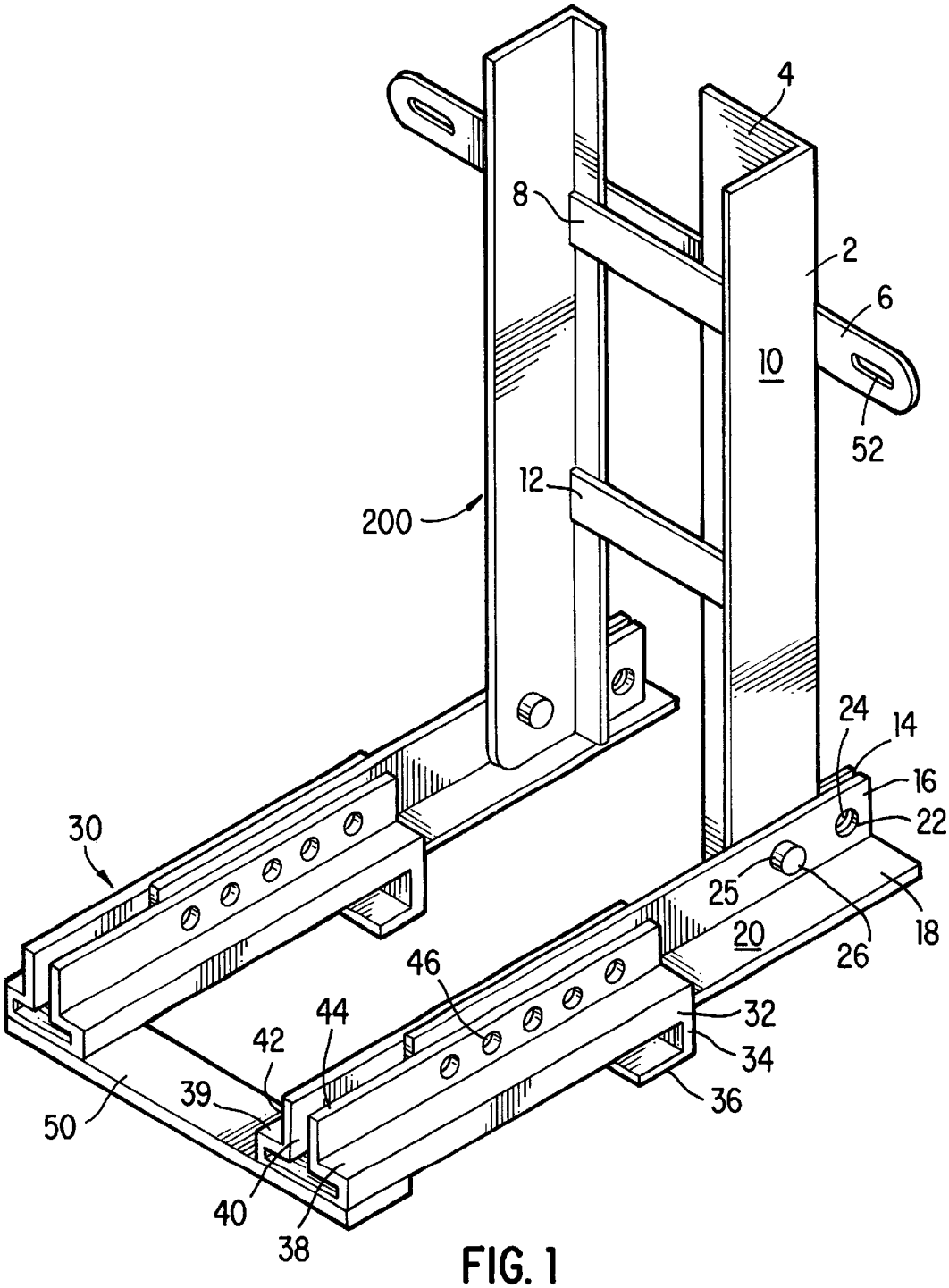
FIG. 1 is a perspective view of the door barricade of the present invention.

With respect to FIG. 1, the door barricade of the present invention is shown in a preferred embodiment. The preferred embodiment comprises a step engaging member, shown generally at 30 and a door stop member which is shown generally at 200. The step engaging member 30 is adapted to securely grip the top step leading to the entry door of an RV and the like and the door stop member 200 is attached to the step engaging member 30 and extends upwardly from the step engaging member 30. When the step engaging member 30 of the door stop barricade of the present invention is functionally installed on the top step of a RV and the like, the door stop member 200 extends upwards from the step and step engaging member 30 and prevents the outwardly swinging door of the RV from opening beyond a predetermined point.

The step engaging member 30 further includes a top step portion 32 and a rear step portion 34 that is in fixed attachment with the top step portion 32 and extends downward from the top section 32. The rear step portion 34 engages with a rear edge of the step that the step engaging member 30 is installed on. Extending from the rear step portion 34 and in spaced relation to the top step portion 30 as depicted in FIG. 1 is a bottom step portion 36. The bottom step portion 36 engages with a bottom edge of the step that the step engaging member 30 is installed on. Positioned opposite the rear step portion 34 and in space relation with respect to the rear step portion 34 is a front step portion 50 that extends downward from the top step portion 32. The front step portion 50 of the step engaging member 30 engages with a front edge of the step that the step engaging member 30 is installed on.

Still referring to FIG. 1, the door stop member 200 of the door barricade is also shown. The door stop member 200 extends upward from the step engaging member 30. Specifically, the upright door stop legs 10 extend upward from the base 20 of the door stop member 200. Typically, there are two upright door stop legs 10. As shown in FIG. 1, the two upright door stop legs 10 preferably further include orthogonally related legs 2 and 4 extending upward from the door stop base 20, comprising upright door stop legs 10. The orthogonally related legs 2 and 4 are typically constructed from iron or metal, as is the rest of the door barricade, due to the well-known strength and hardness of said materials. The two upright stop legs 10 are in spaced relation to each other. Each of the two upright door stop legs 10 are typically pivotally attached to the door stop member base 20 by a pivot pin 26. The pivot pin 26 is in fixed attachment to the upright door stop leg 10, specifically leg 2. The pivot pin 26 is inserted, at least partially, into a pivot pin aperture 26 disposed on door stop base 20. With the pivot pin 26 inserted in the pivot pin aperture 26, the upright door stop legs 10 are free to pivot about pivot pin 25 with respect to the step engaging member 30. It will be appreciate by those skilled in the art that the pivotally attached door stop member 200 can be pivoted down towards the step engaging member 30 and the door stop member base 20 to reduce the overall height profile of the door barricade. The reduced profile gained by the folded door barricade greatly increases the ease with which the door barricade may be stored and transported when not installed on RV or the like steps.

The upright door legs 10 of the door stop member 200 are typically braced by the addition of at least one cross bar spanning the spaced relation between the two upright legs. The preferred embodiment has three bracing cross bars 6, 8 and 12. The cross bar 6 additionally has a pair of eyelet slots 52 disposed therein. The eyelets 52 are provided so that an eye of an eyebolt or other solid fixture securely affixed to the RV and the like structure can be inserted through the eyelets 52 and selectively locked. A clearer understanding of the structural importance and significance of the eyelet slots 52 can be seen by referring to FIG. 3. There, an eyebolt 130 is attached to the structure of the RV and the like, the eyebolt 130 typically extends through the outer wall of the RV and the like and is fixedly attached to a solid and permanent structural member 120 of the RV and the like.

The step engaging member 30 is installed on a RV top step that leads to an entry door 110. The door stop member 200 is then adjust ed so that the door s top member 200 is in close proximity to the RV door 110. The eyebolt 130 is attached to the RV at a height and location on the RV such that the eyebolt 130 and the eyelet slot 52 on the upright door stop 10 aligns with the eyebolt 130 when the door barricade is installed on the top step of the RV and the like. The eyebolt 130 is received in the eyelet slot 52. A locking means may selectively then be installed through the eyebolt to securely fasten the door barricade to the RV or the like.

Figure 2:
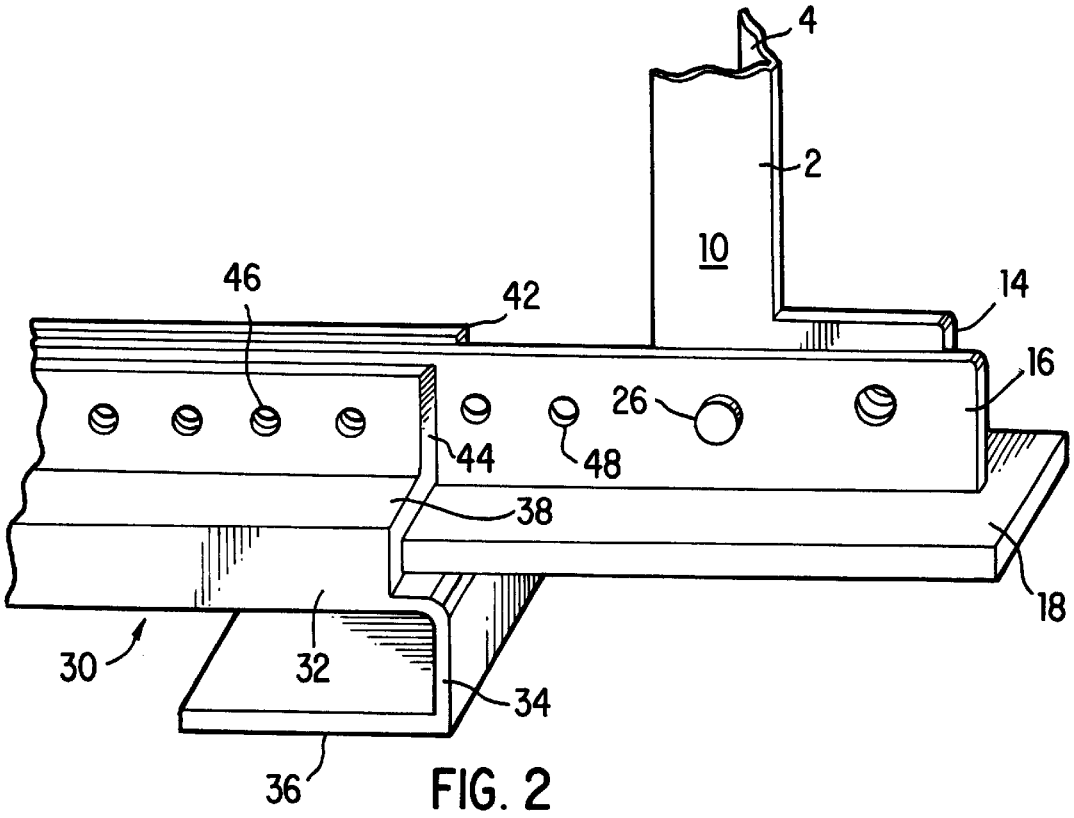
FIG. 2 is a detailed view of the present invention, closely depicting the pivoting, slidingly adjustable and locking details of the preferred embodiment.
Figure 3:
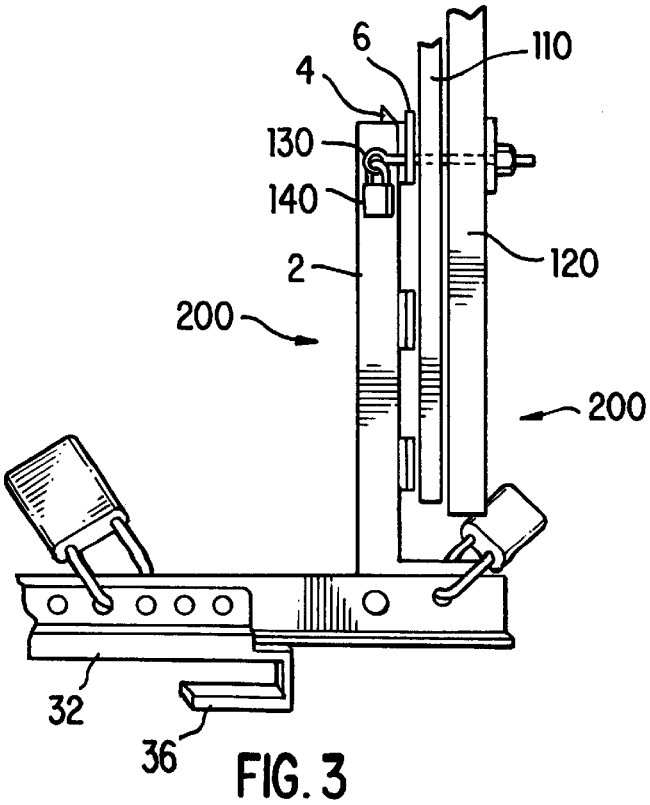
FIG. 3 is a detailed side elevation view depicting the locking characteristics of the present invention.

The step engaging member 30 and the door stop member 200 are typically slidingly adjustable relative to each other as shown throughout FIGS. 1–3. The door stop base 20 is slidingly received in the top step portion 32. A channel 40 is formed in the top of the top step portion 32 by spaced apart shoulders 42 and 44.

Another important feature of the present invention is the locking capabilities of the adjustable and folding members of the door barricade so that the door barricade cannot be removed intentionally by burglars or in the alternative, becomes unintentionally disengaged from the RV The relatively adjustable step engaging member 30 and the door stop member 200 are further provide with a plurality of apertures 46 and 48 which may be aligned and locked at a plurality of predetermined locations such that the door barricade of the present invention may accommodate RVs and the like that have various step-to-door spaced relations.

Installing the step engaging member 30 on the top step of an RV and the like and adjusting the door stop member 200 relative to the step engaging member 30 until the door stop member 200 is in close proximity to the RV door 110 and apertures 46 and 48 are aligned, a separately provided locking means 140 may then be used to secure the step engaging member 30 and the door stop member 200 at the selected predetermined location.

The pivoting door stop member 200 may also be selectively locked so that the door barricade may be used on RVs and the like that do not have anchoring eyebolts 130. The locking and non-pivoting capability of the doorstop member also acts to resist forced entry into the entry door of a RV and the like by presenting the door barricade as a fixed unitary barrier that is extremely difficult to bypass. The door stop base 20 and the door stop upright legs 10 are further provided with apertures 16 and 14 respectfully that are aligned when the door barricade is in the installed and functional configuration. Thus aligned, a separately provided locking means may be used to selectively lock the door barricade in the upright functional configuration, thereby preventing the door barricade from being folded.

As such, the method of making and using the device detailed above constitutes the inventor's preferred embodiment and alternate embodiments to the invention. The inventor is aware that numerous configurations of the device as a whole or some of its constituent parts are available which would provide the desired results. While the invention has been described and illustrated with reference to specific embodiments, it is understood that these and other embodiments may be resorted to without departing from the invention. Therefore, the form of the invention set out above should be considered illustrative and not as limiting the scope of the following claims.

What I claim is:

1. A door barricade for mounting on a door step leading to a door of a recreational vehicle and preventing the opening of the door beyond a predetermined point comprising:

a top step portion dimensioned to fit on top of the door step;

a rear step portion downwardly extending from said top step portion in fixed relation with respect to said top step portion, said rear step portion engaging a rear edge of the door step;

a bottom step portion perpendicularly extending from said rear step portion in fixed relation with respect to said rear step portion and in spaced relation with said top step portion, said bottom step portion engaging a bottom edge of the door step;

a front step portion downwardly extending from said top step portion in fixed relation with respect to said top step portion and in spaced relation with respect to said rear portion and opposite said rear step portion, said front step portion engaging a front edge of the door step; and a door stop member attached to said top step portion, said door stop member further comprising a door stop portion extending upward from said top step portion in close proximity to the door whereby said door stop portion prevents the opening of the door beyond a predetermined point.

2. The door barricade of claim 1 further defining a slot in said top step portion for receiving said door stop member and means for selectively locking said door stop member in said slot at predetermined locations.

3. The door barricade of claim 2 wherein said means for selectively locking said door stop member in said door stop barricade top step slot further includes apertures in both said slot and said door stop member received within said slot, said apertures sufficiently sized whereby aligning said apertures in said slot and said door stop member received within said slot facilitates inserting a locking means through said aligned apertures and thereby selectively locking said door stop member and said top step portion together at predetermined locations.

4. The door stop member of claim 1 further comprising at least one door stop in fixed attachment to said door stop member and extending upward from said door stop member in close proximity to the door whereby said door stop prevents the opening of the door beyond a predetermined point.

5. The door stop member of claim 1 further comprising two door stops in fixed attachment to said door stop member and extending upward from said door stop member in close proximity to the door whereby said two door stops prevent the opening of the door beyond a predetermined point.

6. The door stop member of claim 1 further comprising at least one door stop pivotally attached to said door stop member and extending upward from said door stop member in close proximity to the door whereby said door stop prevents the opening of the door beyond a predetermined point.

7. The door stop member of claim 1 further comprising two door stops pivotally attached to said door stop member and extending upward from said door stop member in close proximity to the door whereby said two door stops prevent the opening of the door beyond a predetermined point.

8. The door stop member of claim 7 further comprising at least one cross member in fixed attachment to said two doors stops whereby said at least one cross bar imparts rigidity and strength to said door stop member.

9. The door stop member of claim 8 further comprising at least one cross bar member eye in said at least one cross bar member wherein said at least one cross bar member eye is sufficiently sized to receive locking means of a recreational vehicle, for selectively locking said door barricade to a recreational vehicle.

10. The door stop member of claim of claim 7 further comprising a plurality of cross members in fixed attachment to said two door stops whereby said plurality of cross bars impart rigidity and strength to said two door stop members.

11. The door stop member of claim 9 further comprising at least one cross bar member eye in at least one of said plurality of cross bar members wherein said at least one cross bar member eye is sufficiently sized to receive locking means of a recreational vehicle, for selectively locking said door barricade to a recreational vehicle.

* * * * *